US005839522A

United States Patent [19]

Allyn et al.

[11] Patent Number: 5,839,522

[45] Date of Patent: Nov. 24, 1998

[54] SLURRY DIVERTER

[76] Inventors: John F. Allyn, 270 Ashpohtag Rd.; Walter G. Allyn, 260 Ashpohtag Rd., both of Norfolk, Conn. 06058

[21] Appl. No.: 931,595

[22] Filed: Sep. 16, 1997

Related U.S. Application Data

[63] Continuation-in-part of Ser. No. 667,355, Jun. 18, 1996.

[51] Int. Cl.[6] ..... E21B 33/00

[52] U.S. Cl. ..... 175/209; 166/88.1

[58] Field of Search ..... 166/88.1, 81.1, 166/84.1; 175/209, 210, 211, 87

[56] References Cited

U.S. PATENT DOCUMENTS

| | | | |
|---|---|---|---|
| 3,965,998 | 6/1976 | Gyongyosi et al. | 175/209 |
| 4,321,975 | 3/1982 | Dyer | 175/209 X |
| 4,889,196 | 12/1989 | Johnston | 175/209 |

OTHER PUBLICATIONS

Allyn Containment Systems, date unknown.

*Primary Examiner*—William P. Neuder
*Attorney, Agent, or Firm*—Alix, Yale & Ristas, LLP

[57] ABSTRACT

A slurry diverter for use in well drilling of the type in which a drill shaft is rotated to drill a bore into the ground includes a housing having a top end with an upper surface and a first aperture within the top end of the housing. The housing also has a second aperture which permits entry of slurry from the drilling bore into the housing. The first and second housing apertures are aligned with the bore during use and permit the drill shaft to pass through the housing. The housing also has an exit port which permits slurry to exit the housing so that the slurry can be diverted away from the drilling site. The slurry diverter further comprises at least one flexible wiper positioned above the upper surface of the top end of the housing. The wiper has a central aperture which is coaxially disposed with the first housing aperture. The wiper seals with the drill shaft such that substantially none of the slurry entering the housing can pass through the first housing aperture. Accordingly, any slurry which enters the housing will be forced out of the exit port defined within the housing. A clamp assembly rigidly clamps the wiper to the housing at least so that the wiper will not rotate with the drill shaft during drilling.

20 Claims, 2 Drawing Sheets

SLURRY DIVERTER

This application is a continuation-in-part application of co-pending U.S. application Ser. No. 08/667,355 filed on Jun. 18, 1996.

BACKGROUND OF THE INVENTION

1. Field of the Invention

The present invention is generally directed to the field of well drilling. More particularly, the present invention relates to slurry diverters for use in well drilling using comparatively low water and/or air pressure. Accordingly, the general objects of the present invention are to provide novel and improved methods and apparatus of such character.

2. Description of the Related Art

Present well drilling techniques produce a slurry of drilling debris, such as water, air, dirt and rock cuttings, which emanates from the drill hole under pressure during drilling. Production of this slurry is due to pressured water and air being forced down through the drill shaft during drilling to lubricate the drill bit. The pressurized air and water then rise up between the outside of the drill shaft and the inside of the well casing carrying with them the drilling debris to thereby clear the drill hole. Naturally, the escape of such slurry at the top of the drill hole causes dirt, etc. to blow into the air in the vicinity of the drill site. This creates a high level of particulate matter in the atmosphere which can get into the surrounding machinery and produce an unpleasant working environment. Naturally, this lowers the life span of compressors and other expensive equipment used in drilling operations and annoys workers.

In order to reduce the damage and inconvenience caused by slurry emanating from the top of the drill hole, slurry diverters have been used to sweep the slurry from the drill shaft and divert the slurry away from the drill site. These slurry diverters have been used in both water well and oil well drilling applications with some degree of success. However, oil well slurry diverters are not well suited for use in water well drilling because they are designed to accommodate the high pressure levels encountered in oil well drilling applications. Accordingly, such designs lack versatility and are expensive and difficult to use.

The related art slurry diverters for use in water well drilling do not need to accommodate high slurry pressures and, therefore, can be less expensive and simpler to use than oil well slurry diverters. However, the related art slurry diverters for water well drilling still suffer from a number of deficiencies.

SUMMARY OF THE INVENTION

It is, accordingly, an object of the present invention to provide an improved slurry diverter for use in well drilling operations which provides improved slurry diverting capabilities by utilizing at least one flexible pipe wiper which is releasably clamped into position around a drill rod to prevent the pipe wiper from rotating with the drill rod in operation and to allow readjustment of the pipe wiper position to accommodate drill rod drift.

It is another object of the present invention to provide an improved slurry diverter for use in well drilling operations in which at least one flexible pipe wiper is clamped to a flat upper surface of a diverter housing such that the pipe wiper is rigidly disposed above the housing.

It is still another object of the present invention to provide an improved slurry diverter for use in water well drilling in which at least one pipe wiper is clamped between an upper surface of a diverter housing and a wiper-compressing member to thereby prevent rotation of the pipe wiper with the drill shaft during drilling operations.

These and other objects and advantages of the present invention are provided in one embodiment by providing a slurry diverter for use in well drilling of the type in which a drill shaft is rotated within a drill casing to drill a bore into the ground. As the drill shaft bores deeper into the earth, pressurized air and water is forced through the center of the shaft to thereby force out debris generated during drilling. The inventive slurry diverter includes a housing having a top end with an upper surface and a first aperture defined within the top end of the housing. The housing also defines a second aperture which permits entry of slurry from the drilling bore into the housing. The first and second housing apertures are aligned with the bore during use and permit the drill shaft to pass through the housing during drilling. The housing also defines an exit port which permits slurry which has entered the housing through the second aperture to exit the housing so that the slurry can be diverted away from the drilling site.

The inventive slurry diverter further comprises at least one flexible wiper positioned above the upper surface of the top end of the housing. The wiper defines a central aperture which is coaxially disposed with the first housing aperture and permits the drill shaft to pass therethrough during drilling. The wiper makes sealing contact with the drill shaft such that substantially none of the slurry entering the housing can pass through the first housing aperture. Accordingly, any slurry which enters the housing will be forced out of the exit port defined within the housing.

The inventive slurry diverter includes a clamp assembly for rigidly clamping the wiper to the housing at least to the extent that the wiper will not rotate with rotation of the drill shaft during drilling. Preferably, the clamp assembly includes at least one releasable clamp which permits readjustment of the pipe wiper position to accommodate drill rod drift. This feature of the invention, thus, improves wiper efficiency and reduces long term wiper wear.

The present invention offers a means of eliminating manual handling or shoveling of slurry and greatly reduces the intake of drilling debris by both the drilling crew and the drilling equipment. Since, using the present invention, slurry is diverted to a remote location relative to the drill site during usage, the drill site remains clean and dry.

BRIEF DESCRIPTION OF THE DRAWINGS

The preferred embodiment of the present invention will be described below with reference to the accompanying drawings wherein like numerals represent like structures and wherein.

DETAILED DESCRIPTION OF THE PREFERRED EMBODIMENT

The preferred embodiment of the slurry diverter of the present invention will now be described with joint reference to FIGS. 1–5. The slurry diverter 10 shown therein is primarily intended for use as a water well drilling accessory and is especially well suited for deepening existing wells. During drilling operations, a drill shaft (not shown) extends through slurry diverter 10 and rotates to drill a bore into the earth in a desired location. Thus, during drilling the drill shaft and the resulting bore define a common axis which is generally perpendicular to the surface of the ground. During drilling, pressurized fluid is forced through the drill shaft to the bottom of the bore whereby dirt and fluids such as water are forced out of the top of the bore at the drill site.

Figure 3:
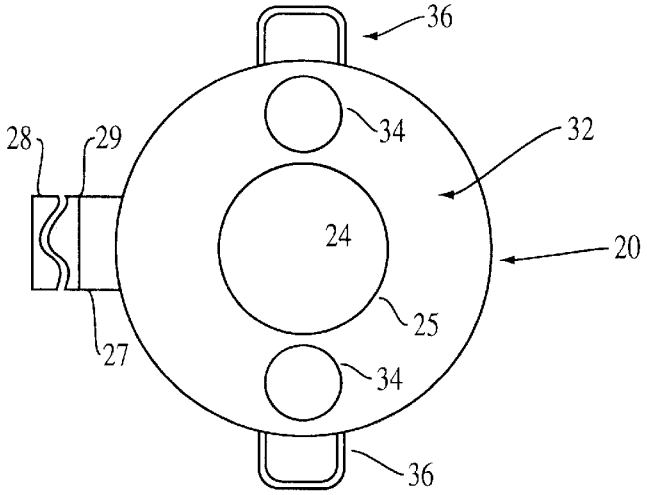
FIG. 3 is a bottom view of the preferred embodiment of the housing and the associated duct portion for the inventive slurry diverter shown in FIGS. 1 and 2, said view being rotated 90° relative to the view of FIG. 2.
Figure 4:
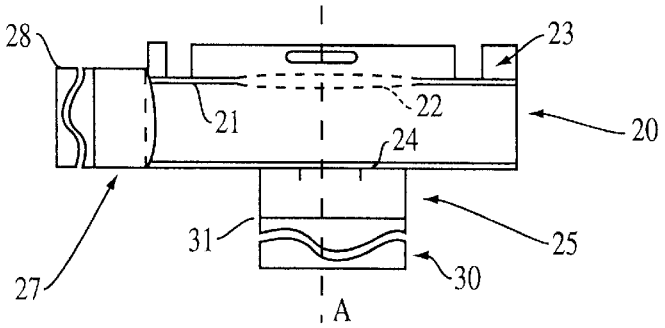
FIG. 4 is a side elevation view of the housing shown in FIG. 3 and a portion of the associated casing.

The preferred embodiment of the inventive slurry diverter 10 comprises an enclosed housing 20, a clamp assembly 40 and a plurality of drill shaft wipers 50 which are clamped to the outside of the housing 20 by the clamp assembly 40. In use, the drill shaft extends through diverter 10 such that the shaft axis is aligned with axis A. As best seen in FIGS. 3 and 4, housing 20 comprises a top end 21, a bottom end 32 and a pair of handles 36. A first aperture 22 is defined within top end 21 and an upper surface 23 is disposed at the upper end thereof. Upper surface 23 of housing top end 21 is preferably flat to ensure a tight seal between wipers 50 and upper surface 23. The bottom end 32 of housing 20 defines a-second aperture 24 and a pair of grouting drains 34. Further, a threaded first coupling 27 preferably extends from housing 20 about an exit port 26 defined therethrough and generally perpendicular to the axis A. A slurry-diverting duct 28 is threadably engaged with first coupling 27 at a first threaded end 29 thereof. An opposite second end of slurry-diverting duct 28 extends to a remote location away from slurry diverter 20. Continuous fluid communication between the inside of housing 20, coupling 27 and slurry-diverting duct 28 is maintained to permit the flow of fluid therethrough to the second end of duct 28.

A second coupling 25 extends from bottom end 32 of housing 20. Coupling 25 is coaxially disposed with first and second apertures 22 and 24 about axis A. Coupling 25 preferably has a threaded end to permit slurry diverter 10 to be threaded onto a threaded bore casing 30.

If, in the alternative, the bore casing 30 is unthreaded at the first end 31 thereof, a compression adapter can be used to affix slurry diverter 10 to bore casing 30. Naturally, the bore casing 30 is normally disposed within the bore such that first end 31 extends above the surface of the ground while a second and opposite end thereof (not shown) is disposed below the surface of the ground within the bore.

During drilling, a drill shaft (not shown) extends through housing 20 and bore casing 30 and into the ground for rotation therein. As the slurry is forced out of the bore, it travels upwardly through bore casing 30, coupling 25 and second aperture 24 and passes into the interior of housing 20. If desired, grouting drains 34 can be selectively opened to permit at least some of the slurry within housing 20 to escape to the immediate vicinity of bore. Thus, this slurry can be used as grouting material to seal the space between bore casing 30 and the bore.

Handles 36 can be used to assist with the mounting, dismounting and transportation of diverter 10 as desired.

Figure 1:
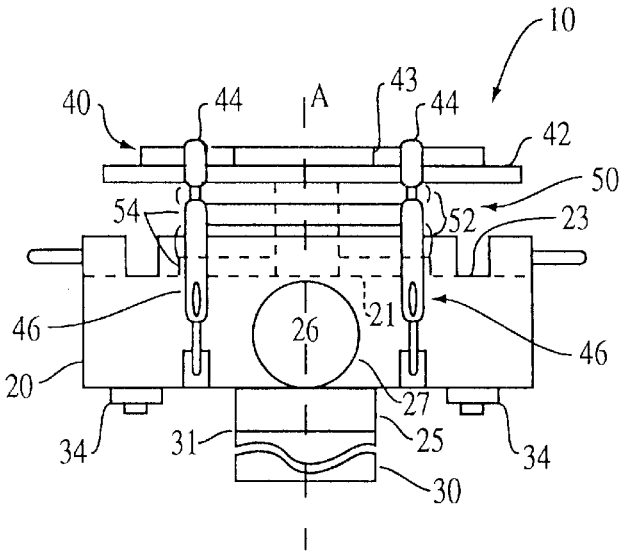
FIG. 1 is a side elevation view, partly in phantom, of the preferred embodiment of the inventive slurry diverter and a portion of an associated casing.

With primary reference now to FIG. 1, the preferred arrangement of wipers 50 will now be described in greater detail. As shown therein, flexible wipers 50 are preferably disposed above upper surface 23 of housing top end 21. Each of the wipers has a central aperture which is coaxially disposed with first housing aperture 22. Central apertures 53 permit the drill shaft (not shown) to pass therethrough during drilling while wipers 50 make sealing contact with the drill shaft such that substantially none of the slurry which has entered housing 20 can pass through first housing aperture 22. Rather, the slurry is forced back into the interior of housing 20. The preferred slurry diverter 10 includes exactly four wipers, two of which are crown type wipers 52 and two of which are flat type wipers 54. Crown wipers 52 and flat-wipers 54 are preferably alternately arranged such that crown wipers 52 do not contact one another and flat wipers 54 do not contact one another.

Figure 2:
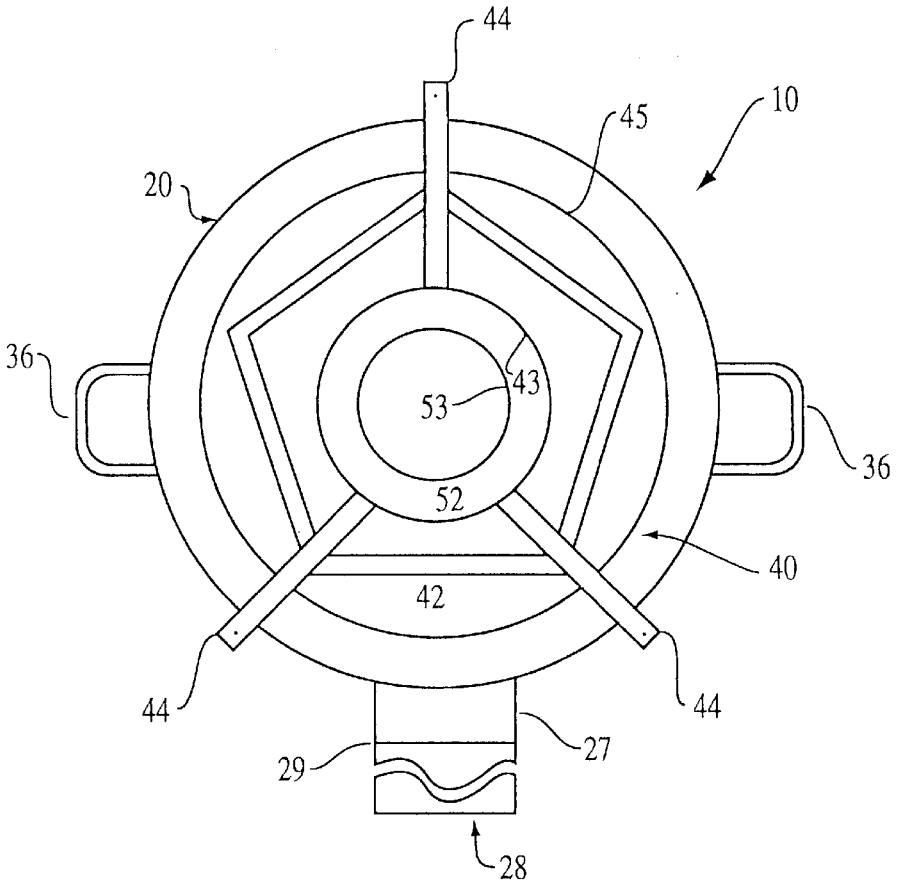
FIG. 2 is a top plan view of the inventive slurry diverter shown in FIG. 1 and a portion of an associated duct.
Figure 5:
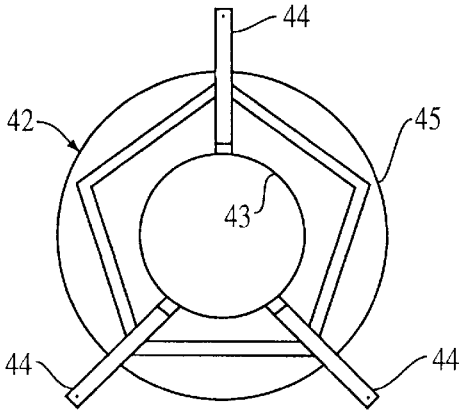
FIG. 5 is a top plan view of a portion of the clamping assembly shown in FIGS. 1 and 2.

With joint reference to FIGS. 1, 2 and 5, clamp assembly 40 will be described in greater detail. As shown therein, clamp assembly 40 preferably includes a wiper-compressing member 42 in the form of a rigid plate having a periphery 45 and exactly three arms 44 which extend outside of periphery 45. Plate 42 preferably defines a member-aperture 43 which is aligned with apertures 53, 22 and 24 and axis A for permitting the drill shaft to pass therethrough during drilling. Clamp assembly 40 additionally includes three releasable clamps 46 extending between arms 44 of wiper-compressing member 42 and housing 20. Clamps 46 are preferably chain binder clamps which, upon actuation thereof, cause wiper-compressing member 42 to apply a compressive force to wipers 50, whereby wipers 50 are rigidly maintained against upper surface 23 of housing 20. This compressive force is preferably sufficient to prevent rotation of wipers 50 during rotation of the drill shaft during drilling. The compressive force is also preferably sufficient to maintain a fluid seal between each of wipers 50 and upper surface 23 of housing 20 to prevent the flow of slurry therethrough. Chain binder clamps 46 are preferably adjustable to permit adjustment of the compressive force applied to wipers 50 upon actuation of clamps 46. Since clamps 46 are preferably releasable clamps, the position of wipers 52 can be readjusted as desired to accommodate drill rod drift during operation thereby ensuring maximum wiping efficiency and minimum wiper wear.

As shown in various figures, member-aperture 43, first and second housing apertures 22 and 24 are all preferably larger than central apertures 53 of wipers 50. This permits the drill shaft to freely pass through slurry diverter 10 while allowing wipers 50 to sealingly engage the outer surface of the drill shaft.

While a preferred embodiment of the present invention has been described, various modifications and substitutions may be made thereto without departing from the spirit and scope of the invention. Accordingly, it is to be understood that the present invention has been described by way of illustration and not limitation.

We claim:

1. A slurry diverter for use in well drilling of the type in which a drill shaft is rotated to drill an axis-defining bore in the ground and in which pressurized air and/or other fluids are passed into the bore whereby slurry is forced out of the bore during drilling, said slurry diverter comprising:

an enclosed housing having a top end which defines a first aperture and an upper surface, said housing defining a second aperture which permits entry of slurry from the bore into said housing, said first and second apertures being aligned with the bore axis for permitting the drill shaft to pass therethrough during drilling, and said housing further defining an exit port for permitting slurry to exit said housing whereby the slurry can be diverted away from said bore;

at least one flexible wiper disposed above said upper surface, said wiper having a central aperture which is coaxially disposed with said first housing aperture and which permits the drill shaft to pass therethrough during drilling while said wiper makes sealing contact with the drill shaft such that substantially none of the slurry entering said housing can pass through said first housing aperture;

a clamp assembly for clamping said wiper to said housing such that rotation of the drill shaft during drilling does not cause rotation of said wiper;

a wiper-compressing member axially spaced from said upper surface of said housing top end, said member defining a member-aperture aligned with the bore axis for permitting the drill shaft to pass therethrough during drilling; and at least one releasable clamp extending between said wiper-compressing member and said housing such that actuation of the clamp causes said wiper-compressing member to apply a compressive force to said wiper whereby said wiper is maintained against said upper surface of said housing.

2. The slurry diverter of claim 1, wherein said clamp assembly includes three releasable clamps;

said wiper-compressing member comprises a rigid plate having a periphery and three arms; and each of said arms has an outer end which extends outside of said periphery and is attached to one of said clamps.

3. The slurry diverter of claim 2, wherein said diverter includes four of said wipers which are coaxially aligned with one another;

two of said wipers are crown wipers;

two of said wipers are flat wipers; and said crown wipers and said flat wipers are alternately arranged whereby said two crown wipers do not contact one another and said two flat wipers do not contact one another.

4. The slurry diverter of claim 2, wherein said diverter only includes an even number of said wipers, said wipers being coaxially aligned with one another;

half of said wipers are crown wipers;

half of said wipers are flat wipers; and said crown wipers and said flat wipers are alternately arranged whereby said crown wipers do not contact one another and said flat wipers do not contact one another.

5. The slurry diverter of claim 2, wherein said clamp assembly includes means for permitting readjustment of the position of said wiper to thereby accommodate drill rod drift whereby wiper efficiency is maximized and wiper wear is minimized.

6. The slurry diverter of claim 1, wherein said diverter includes four of said wipers which are coaxially aligned with one another;

two of said wipers are crown wipers;

two of said wipers are flat wipers; and said crown wipers and said flat wipers are alternately arranged whereby said two crown wipers do not contact one another and said two flat wipers do not contact one another.

7. The slurry diverter of claim 1, wherein said diverter only includes an even number of said wipers, said wipers being coaxially aligned with one another;

half of said wipers are crown wipers;

half of said wipers are flat wipers; and said crown wipers and said flat wipers are alternately arranged whereby said crown wipers do not contact one another and said flat wipers do not contact one another.

8. A slurry diverter for use in well drilling of the type in which a drill shaft is rotated to drill an axis-defining bore in the ground and in which pressurized air and/or other fluids are passed into the bore whereby slurry is forced out of the bore during drilling, said slurry diverter comprising:

an enclosed housing having a top end which defines a first aperture and an upper surface, said housing defining a second aperture which permits entry of slurry from the bore into said housing, said first and second apertures being aligned with the bore axis for permitting the drill shaft to pass therethrough during drilling, and said housing further defining an exit port for permitting slurry to exit said housing whereby the slurry can be diverted away from said bore;

at least one flexible wiper disposed above said upper surface, said wiper having a central aperture which is coaxially disposed with said first housing aperture and which permits the drill shaft to pass therethrough during drilling while said wiper makes sealing contact with the drill shaft such that substantially none of the slurry entering said housing can pass through said first housing aperture; and a clamp assembly for clamping said wiper to said housing such that rotation of the drill shaft during drilling does not cause rotation of said wiper, wherein said clamp assembly includes means for permitting readjustment of the position of said wiper to thereby accommodate drill rod drift whereby wiper efficiency is maximized and wiper wear is minimized.

9. The slurry diverter of claim 8, wherein said clamp comprises a chain binder.

10. The slurry diverter of claim 8, wherein said diverter only includes an even number of said wipers, said wipers being coaxially aligned with one another;

half of said wipers are crown wipers;

half of said wipers are flat wipers; and said crown wipers and said flat wipers are alternately arranged whereby said crown wipers do not contact one another and said flat wipers do not contact one another.

11. A slurry diverter for use in well drilling of the type in which a drill shaft is rotated to drill an axis-defining bore in the ground and in which pressurized air and/or other fluids are passed into the bore whereby slurry is forced out of the bore during drilling, said slurry diverter comprising:

an enclosed housing having a top end which defines a first aperture and an upper surface, said housing defining a second aperture which permits entry of slurry from the bore into said housing, said first and second apertures being aligned with the bore axis for permitting the drill shaft to pass therethrough during drilling, and said housing further defining an exit port for permitting slurry to exit said housing whereby the slurry can be diverted away from said bore;

at least one flexible wiper disposed above said upper surface, said wiper having a central aperture which is coaxially disposed with said first housing aperture and which permits the drill shaft to pass therethrough during drilling while said wiper makes sealing contact with the drill shaft such that substantially none of the slurry entering said housing can pass through said first housing aperture; and a clamp assembly for clamping said wiper to said housing such that rotation of the drill shaft during drilling does not cause rotation of said wiper;

wherein said diverter includes four of said wipers which are coaxially aligned with one another;

wherein two of said wipers are crown wipers;

wherein two of said wipers are flat wipers; and wherein said crown wipers and said flat wipers are alternately arranged whereby said two crown wipers do not contact one another and said two flat wipers do not contact one another.

12. The slurry diverter of claim 11, wherein said clamp assembly includes means for permitting readjustment of the position of said wiper to thereby accommodate drill rod drift whereby wiper efficiency is maximized and wiper wear is minimized.

13. A slurry diverter for use in well drilling of the type in which a drill shaft is rotated to drill an axis-defining bore in the ground and in which air and/or other fluids are passed into the bore whereby slurry is forced out of the bore during drilling, said slurry diverter comprising:

an enclosed housing having a top end which defines a first aperture and an upper surface, said housing defining a second aperture which permits entry of slurry from the bore into said housing, said first and second apertures being aligned with the bore axis for permitting the drill shaft to pass therethrough during drilling, and said housing further defining an exit port for permitting slurry to exit said housing whereby the slurry can be diverted away from said bore;

at least one flexible wiper disposed above said upper surface, said wiper having a central aperture which is coaxially disposed with said first housing aperture and which permits the drill shaft to pass therethrough during drilling while said wiper makes sealing contact with the drill shaft such that substantially none of the slurry entering said housing can pass through said first housing aperture; and a clamp assembly for clamping said wiper to said housing such that rotation of the drill shaft during drilling does not cause rotation of said wiper;

wherein said diverter only includes an even number of said wipers, said wipers being coaxially aligned with one another;

wherein half of said wipers are crown wipers;

wherein half of said wipers are flat wipers; and wherein said crown wipers and said flat wipers are alternately arranged whereby said crown wipers do not contact one another and said flat wipers do not contact one another.

14. The slurry diverter of claim 13, wherein said clamp assembly includes means for permitting readjustment of the position of said wiper to thereby accommodate drill rod drift whereby wiper efficiency is maximized and wiper wear is minimized.

15. A slurry diverter for use in well drilling of the type in which a drill shaft is rotated to drill an axis-defining bore in the ground and in which air and/or other fluids are passed into the bore whereby slurry is forced out of the bore during drilling, said slurry diverter comprising:

an enclosed housing having a top end which defines a first aperture and an upper surface, said housing defining a second aperture which permits entry of slurry from the bore into said housing, said first and second apertures being aligned with the bore axis for permitting the drill shaft to pass therethrough during drilling, and said housing further defining an exit port for permitting slurry to exit said housing whereby the slurry can be diverted away from said bore, said housing further comprising a second threaded coupling disposed about said second aperature and a bore-casing, said bore-casing having a first threaded end which is in threaded engagement with said second threaded coupling and a second end which is located within the bore whereby slurry forced out of the bore passes between the drill shaft and said bore-casing and into said housing;

at least one flexible wiper disposed above said upper surface, said wiper having a central aperture which is coaxially disposed with said first housing aperture and which permits the drill shaft to pass therethrough during drilling while said wiper makes sealing contact with the drill shaft such that substantially none of the slurry entering said housing can pass through said first housing aperture; and a clamp assembly for clamping said wiper to said housing such that rotation of the drill shaft during drilling does not cause rotation of said wiper.

16. The slurry diverter of claim 15, wherein said clamp assembly includes means for permitting readjustment of the position of said wiper to thereby accommodate drill rod drift whereby wiper efficiency is maximized and wiper wear is minimized.

17. A slurry diverter for use in well drilling of the type in which a drill shaft is rotated to drill an axis-defining bore in the ground and in which air and/or other fluids are passed into the bore whereby slurry is forced out of the bore during drilling, said slurry diverter comprising:

an enclosed housing having a top end which defines a first aperture and an upper surface, said housing defining a second aperture which permits entry of slurry from the bore into said housing, said first and second apertures being aligned with the bore axis for permitting the drill shaft to pass therethrough during drilling, and said housing further defining an exit port for permitting slurry to exit said housing whereby the slurry can be diverted away from said bore, said housing further comprising a second coupling disposed about said second aperture and a bore-casing having an unthreaded first end with a compression adapter which is in engagement with said second coupling and a second end which is located within the bore whereby slurry forced out of the bore passes between the drill shaft and said bore-casing and into said housing;

at least one flexible wiper disposed above said upper surface, said wiper having a central aperture which is coaxially disposed with said first housing aperture and which permits the drill shaft to pass therethrough during drilling while said wiper makes sealing contact with the drill shaft such that substantially none of the slurry entering said housing can pass through said first housing aperture; and a clamp assembly for clamping said wiper to said housing such that rotation of the drill shaft during drilling does not cause rotation of said wiper.

18. The slurry diverter of claim 17, wherein said clamp assembly includes means for permitting readjustment of the position of said wiper to thereby accommodate drill rod drift whereby wiper efficiency is maximized and wiper wear is minimized.

19. A slurry diverter for use in well drilling of the type in which a drill shaft is rotated to drill an axis-defining bore in the ground and in which pressurized air and/or other fluids are passed into the bore whereby slurry is forced out of the bore during drilling, said slurry diverter comprising:

an enclosed housing having a top end which defines a first aperture and an upper surface, said housing defining a second aperture which permits entry of slurry from the bore into said housing, said first and second apertures being aligned with the bore axis for permitting the drill shaft to pass therethrough during drilling, and said housing further defining an exit port for permitting slurry to exit said housing whereby the slurry can be diverted away from said bore, said housing further comprising at least one grouting drain for selectively permitting some of the slurry to exit said housing;

at least one flexible wiper disposed above said upper surface, said wiper having a central aperture which is coaxially disposed with said first housing aperture and which permits the drill shaft to pass therethrough during drilling while said wiper makes sealing contact with the drill shaft such that substantially none of the slurry entering said housing can pass through said first housing aperture; and a clamp assembly for clamping said wiper to said housing such that rotation of the drill shaft during drilling does not cause rotation of said wiper.

20. The slurry diverter of claim 19, wherein said clamp assembly comprises:

a wiper-compressing member disposed above said upper surface of said housing top end, said member having a member-aperture aligned with the bore axis for permitting the drill shaft to pass therethrough during drilling;

at least one releasable clamp extending between said wiper-compressing member and said housing such that actuation of the clamp causes said wiper-compressing member to apply a compressive force to said wiper whereby said wiper is rigidly maintained against said upper surface of said housing.

* * * * *